United States Patent [19]

Miller et al.

[11] Patent Number: 4,741,742

[45] Date of Patent: May 3, 1988

[54] DIAZIDO ALKANES AND DIAZIDO ALKANOLS AS COMBUSTION MODIFIERS FOR LIQUID HYDROCARBON RAMJET FUELS

[75] Inventors: Richard S. Miller, Crofton, Md.; Robert M. Moriarty, Oak Park, Ill.; Chung K. Law, Davis, Calif.

[73] Assignee: The United States of America as represented by the Secretary of the Navy, Washington, D.C.

[21] Appl. No.: 881,756

[22] Filed: Jul. 3, 1986

[51] Int. Cl.[4] ..... C10L 1/22

[52] U.S. Cl. ..... 44/64; 44/77

[58] Field of Search ..... 44/64

[56] References Cited

U.S. PATENT DOCUMENTS

| | | | |
|---|---|---|---|
| 3,321,494 | 5/1967 | Niles | 44/64 |
| 3,520,665 | 7/1970 | McConnell | 44/64 |
| 4,268,450 | 5/1981 | Frankel et al. | 525/403 |
| 4,280,819 | 7/1981 | Hartle et al. | 44/64 |
| 4,303,414 | 12/1981 | Frankel et al. | 44/64 |

*Primary Examiner*—William R. Dixon, Jr.
*Assistant Examiner*—Ellen M. McAvoy
*Attorney, Agent, or Firm*—Kenneth E. Walden; Roger D. Johnson

[57] ABSTRACT

A liquid hydrocarbon ramjet fuel containing a additive which is a diazido alkane of the formula $N_3CH_2(CH_2)_nCH_2N_3$ wherein n is an integer of from 1 to 20 or a diazido alkanol of the formula $N_3CH_2(CH_2)_xCHOH(CH_2)_yCH_2N_3$ wherein x is an integer of from 0 to 9, y is an integer of from 0 to 19, x+y is an integer of from 0 to 19, and $x \leqq y$.

9 Claims, 2 Drawing Sheets

DIAZIDO ALKANES AND DIAZIDO ALKANOLS AS COMBUSTION MODIFIERS FOR LIQUID HYDROCARBON RAMJET FUELS

BACKGROUND OF THE INVENTION

This invention relates to liquid hydrocarbon jet fuels and more particularly to azido additives to liquid hydrocarbon ramjet fuels.

In most liquid-fueled combustors such as the ramjet, the fuel is directly introduced into the upstream flow section of the combustion chamber in the form of sprays of droplets. These droplets subsequently mix with the external gas, heat up, gasify, combust, and thereby release heat to provide the propulsion energy. It is therefore obvious that the rates of gasification and mixing would closely affect the chemical heat release rate and consequently such important performance parameters as combustion efficiency and the tendency to exhibit combustion instability.

Attempts at enhancing the overall droplet gasification rate, and thereby reducing the combustor size, have emphasized the production of small droplets through spraying as well as increasing the gasification rates of individual droplets. Both approaches, however, have inherent difficulties. Concerning atomization, we note that there are three factors which place lower limits on the attainable droplet size. The first is that physically, droplets of infinitesimally small sizes cannot be produced through spraying. Secondly, exceedingly small droplets also lack sufficient inertia for penetration and therefore are undesirable from consideration of macroscale mixing and homogeneity. Thus relying on spraying alone frequently cannot yield optimum gasification rate and mixture homogeneity. The third factor is that recent studies on the behavior of dense sprays have shown that even if very small droplets can indeed be produced, they will nevertheless collide and coalesce into much bigger droplets in the dense spray region next to the nozzle.

Concerning the droplet gasification rate, it is also well established that, for conventional hydrocarbon fuels, this rate is quite insensitive to changes in the system parameters in that while increases of tens of percents can be achieved through, say, convective augmentation or oxygen enrichment, increases by a factor of two or more are difficult to attain.

SUMMARY OF THE INVENTION

Accordingly, an object of this invention is to provide a new, improved jet fuel.

Another object of this invention is to provide new additives for jet fuels.

A further object of this invention is to provide a more efficient jet fuel.

Yet another object of this invention is to reduce the ignition time for jet fuels.

Still a further object of this invention is to improve the mixing characteristic of the jet fuel spray.

These and other objects of this invention are accomplished by providing:

a liquid hydrocarbon ramjet fuel comprising from more than zero to 100 weight percent of a diazido alkane of the formula $N_3CH_2(CH_2)_nCH_2N_3$ wherein n is an integer of from 1 to 20 or of a diazido alkanol of the formula $N_3CH_2(CH_2)_xCHOH(CH_2)_yCH_2N_3$ wherein x is an integer of from 0 to 9, y is an integer of from 0 to 19 x+y is an integer of from 0 to 19, and $x \leqq y$ and the balance being a conventional jet fuel.

BRIEF DESCRIPTION OF THE DRAWINGS

FIGS. 1–5 are discussed in the experimental section.

DETAILED DESCRIPTION OF THE PREFERRED EMBODIMENT

Figure 1:
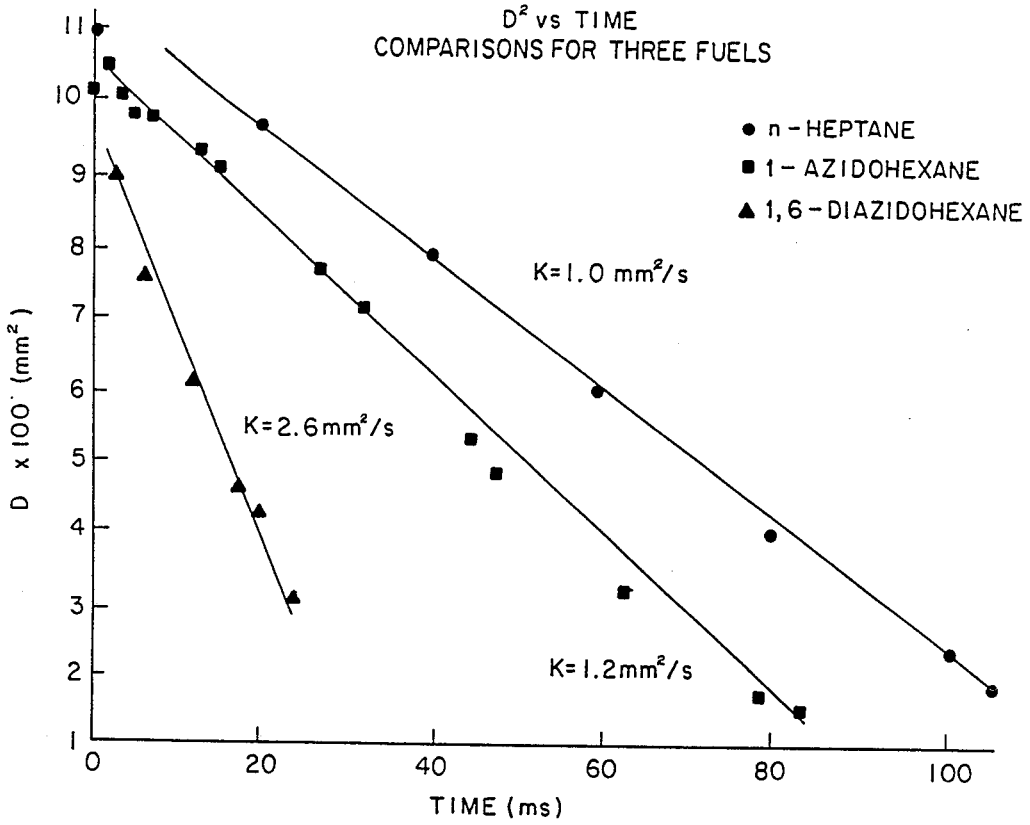
FIG. 1 presents a plot of the square of the instantaneous droplet diameter ($D^2$) versus time for n-heptane, 1-azidohexane, and 1,2-diazidohexane.

The burn rates and thus efficiencies of liquid hydrocarbon fuels in ramjets is increased by the addition of diazido alkanes to the fuel. Note that while monoazido alkanes have only a slightly higher burn rates than their corresponding alkanes, the diazido alkanes have much higher burn rates. The burn rate decreases with branching and therefore straight chain diazido alkanes are used. These diazido alkanes include compounds of the general formula $N_3CH_2(CH_2)_nCH_2N_3$ wherein n is an integer of from 1 to 20 and preferably of from 1 to 8. The diazido alkane additive comprises from more than zero to 100, preferably from more than zero to less than 50, more preferably from 0.5 to 20, and still more preferably from 0.5 to 10 weight percent of the improved liquid hydrocarbon ramjet fuel mixture.

Diazido alkanols are the preferred additives, even over the corresponding diazido alkanes. For example, the burning rate constant is 10.4 $mm^2/s$ for 1,3-diazido-2-propanol as compared to 6.7 $mm^2/s$ for 1,3-diazidopropane ($K=1.0$ $mm^2/s$ for n-heptane). It is critical that the hydroxy group be on the diazido molecule and not merely present in the fuel mixture. Diazido alkanols which may be used include compounds of the general formula $N_3CH_2(CH_2)_xCHOH(CH_2)_yCH_2N_3$ wherein x is an integer of 0 to 9, y is an integer of from 0 to 19, x+y is an integer of from 0 to 19, and $x \leqq y$. Preferably x is an integer of from 0 to 3, y is an integer of from 0 to 7, x+y is an integer of from 0 to 7, and $x \leqq y$. These diazido alkanols are monohydric straight chained alcohols which correspond to the diazo alkanes described above. The single hydroxy group may be located on any carbon atom except one of the adizo-substituted terminal carbon atoms. The diazido alkanol additive comprises from more than zero to 100, preferably from more than zero to less than 50, more preferably from 0.5 to 20, and still more preferably from 0.5 to 10 weight percent of the improved liquid hydrocarbon ramjet fuel mixture.

The general nature of the invention having been set forth, the following examples are presented as specific illustrations thereof. It will be understood that the invention is not limited to these examples but is susceptible to various modifications that will be recognized by one of ordinary skill in the art.

EXPERIMENTAL

The experiments involved the combustion of freely-falling droplets in the postcombustion zone of a flat-flame burner. The droplets were generated by the ink-jet printing technique which yielded a stream of mono-dispersed droplets of controlled size, spacing, and velocity. The temperature and composition of the combustion products from the flat-flame burner could be manipulated by varying the composition of the premixed gas consisting of methane, oxygen, and air. Thus the combustion environment of the droplets could be controlled.

The droplet image was photographically determined using strobe lighting synchronized with the ink-jet pulse generator. Temporal variation of the image was controlled by a delay circuit. The extremely short flash duration of the strobe light essentially freezes the droplet motion. It may also be mentioned that in the experiments both the gas as well as the droplet streams were very steady. The droplet location did not wander more than one-quarter of the droplet diameter early in the lifetime, and one droplet diameter in the later stages. This assured the high accuracy and reliability of the data obtained.

In the present experiments the initial droplet diameter was varied from 250 to 350 μm, the initial droplet velocity was about 80 cm/s, and the droplet spacing was in excess of 100 droplet diameters so that there was practically no droplet-droplet interaction. The droplet Reynolds number is estimated to have always been less than one.

In the case of droplet combustion the oxygen concentration was at 21 mole percent while the gas temperature was at 1150° K. For pure vaporization the oxygen concentration was essentially zero while the gas temperature was again at about 1150° K. Further details about the experimental arrangement can be found in Wang, C. H., Liu, X. Q., and Law, C. K., "Combustion and MicroExplosion of Freely-Falling Multicomponent Droplets", *Combustion and Flame,* Vol. 56, pp. 175–197, (1984), herein incorporated by reference.

The time-integrated photographs of flame streaks of the free-falling droplet streams of three fuels, namely n-heptane, 1-azidohexane, and 1,6-diazidohexane were compared. The heptane burning sequence was characterized by a blue flame and quiescent termination, without any indication of micro-explosion. For the azido fuel, the burning time was reduced while the burning was also terminated by a mild micro-explosion. The greatest change, however, occurred for the diazido fuel which exhibited a significantly reduced burning time, a larger flame dimension, and a violent termination behavior. It is clear that azido fuels, especially the diazides, require much less time for complete droplet gasification.

FIG. 1 quantifies the enhanced gasification rates of the azido fuels by plotting the square of the instantaneous droplet diameter D versus time t. The results show that the $d^2$-Law is obeyed for all three fuels when the burning is quiescent. The slopes then yield the burning rate constants $$K = -\frac{dD^2}{dt}$$

The value of K for heptane is 1.0 $mm^2/s$, which is within the range of the accepted values in the literature, thereby validating the present methodology. The results of FIG. 1 then clearly demonstrate that while the 1-azidohexane exhibits only a moderate 20% increase in the burning rate, the burning rate constant of the 1,6-diazidohexane is 2.6 times that of heptane.

Figure 2:
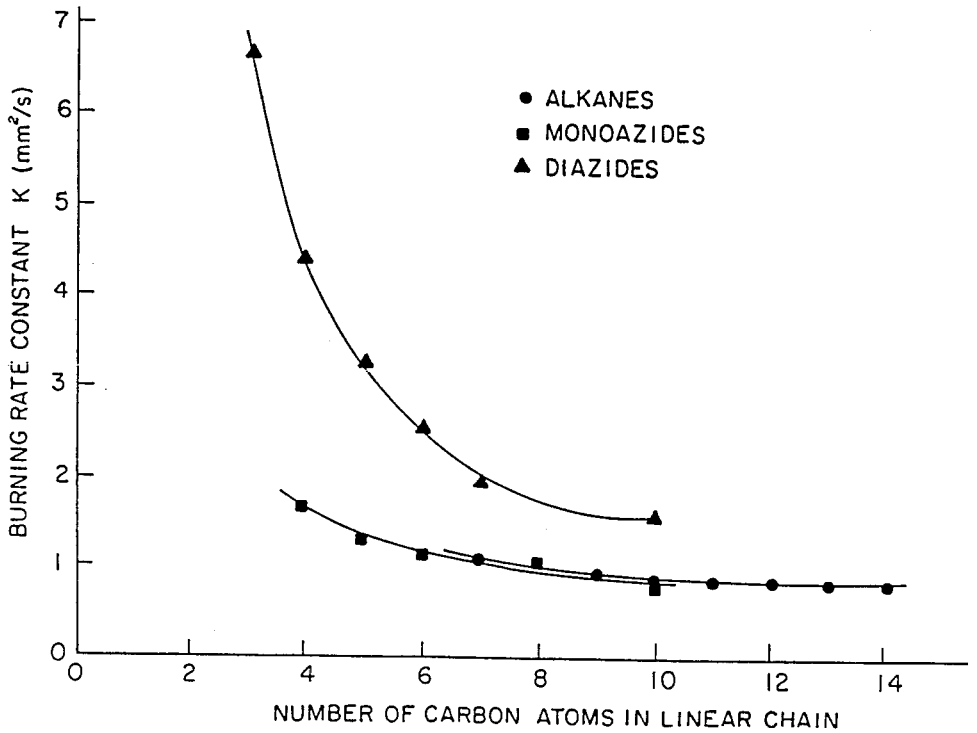
FIG. 2 presents a plot of the burn rate constant (K) versus the number of carbon atoms for normal alkanes, monoazides, and diazides.

FIG. 2 further documents such increases by plotting K versus the number of carbon atoms for straight chain molecules of the three families of alkanes, monoazides, and diazides. The significant increase in K for the diazides is impressive. In the extreme case of diazido-propane, $K=6.7$ $mm^2/s$ as compared to $K=1.0$ $mm^2/s$ for n-heptane.

We have also determined the normalized droplet size at micro-explosion, De/Do, where De is the explosion droplet size and Do the initial droplet size. It is seen from Table 1 that the diazides micro-explode earlier than the monoazides. Note that 1,10-diazidodecane explodes very early and therefore has the shortest burning time.

Because of the occurrence of micro-explosion, from the practical point of view a more useful indication of the burning rate of a fuel is not K but rather an effective burning rate constant defined as $$K' = D_0^2/t_e$$

where $t_e$ is the time to achieve micro-explosion. K′ accounts for the faster regression rate of the droplet before the occurrence of micro-explosion and the fact that micro-explosion also shortens the lifetime of the droplet. Table 1 shows that K′ is generally larger than K, hence further substantiating the potential of azides as fast burning fuels.

We have also determined the values of K for droplets undergoing pure vaporization. The results are summarized in Table 2. It is of significance to note that the gasification rates of diazides are again substantially higher than those of the alkanes.

TABLE 1

A Comparison of Burning Rate Constants, K, Effective Burning Rate Constants, K′, and Relative Micro-Explosion Diameters, $D_e/D_o$, for Several Monoazides and Diazides.

| | Mono-Azides | | | Di-Azides | | |
|---|---|---|---|---|---|---|
| Base Compound | K($mm^2/s$) | K′($mm^2/s$) | $D_e/D_o$ | K($mm^2/s$) | K′($mm^2/s$) | $D_e/D_o$ |
| Propane | — | — | — | 6.70 | 9.04 | 0.48 |
| Butane | 1.65 | 1.84 | 0.37 | 4.48 | 5.11 | 0.45 |
| Pentane | 1.30 | 1.40 | 0.34 | 3.30 | 3.96 | 0.45 |
| Hexane | 1.18 | 1.22 | 0.23 | 2.65 | 3.17 | 0.46 |
| Heptane | 1.15 | — | — | 2.06 | 3.19 | 0.67 |
| Octane | 1.10 | 1.50 | — | — | — | — |
| Nonane | 0.86 | — | — | — | — | — |

TABLE 1-continued

A Comparison of Burning Rate Constants, K, Effective Burning Rate Constants, K', and Relative Micro-Explosion Diameters, $D_e/D_o$, for Several Monoazides and Diazides.

| | Mono-Azides | | | Di-Azides | | |
|---|---|---|---|---|---|---|
| Base Compound | K($mm^2/s$) | K'($mm^2/s$) | $D_e/D_o$ | K($mm^2/s$) | K'($mm^2/s$) | $D_e/D_o$ |
| Decane | 0.82 | 0.94 | 0.25 | 1.70 | 5.26 | 0.86 |

TABLE 2

A Comparison of Vaporization Rate Constant, $K_v$, for Several Monoazides and Diazides.

| | Alkanes | | Mono-Azides | | Di-Azides | |
|---|---|---|---|---|---|---|
| Base Compound | Boiling Point (°C.) | K($mm^2/s$) | Boiling Point (°C.) | $K_v$($mm^2/s$) | Boiling Point (°C.) | $K_v$($mm^2/s$) |
| Propane | −42.1 | — | — | — | 180 | — |
| Butane | −0.5 | — | 109 | — | — | — |
| Pentane | 36.1 | — | 132 | 0.88 | 232 | 1.82 |
| Hexane | 69.0 | — | 156 | 0.78 | 242 | 1.58 |
| Heptane | 98.4 | 0.75 | 178 | 0.73 | 248 | — |
| Octane | 125.7 | 0.72 | 195 | 0.71 | — | — |
| Nonane | 150.8 | 0.65 | 206 | 0.63 | — | — |
| Decane | 174.1 | 0.54 | — | — | 295 | — |

Figure 3:
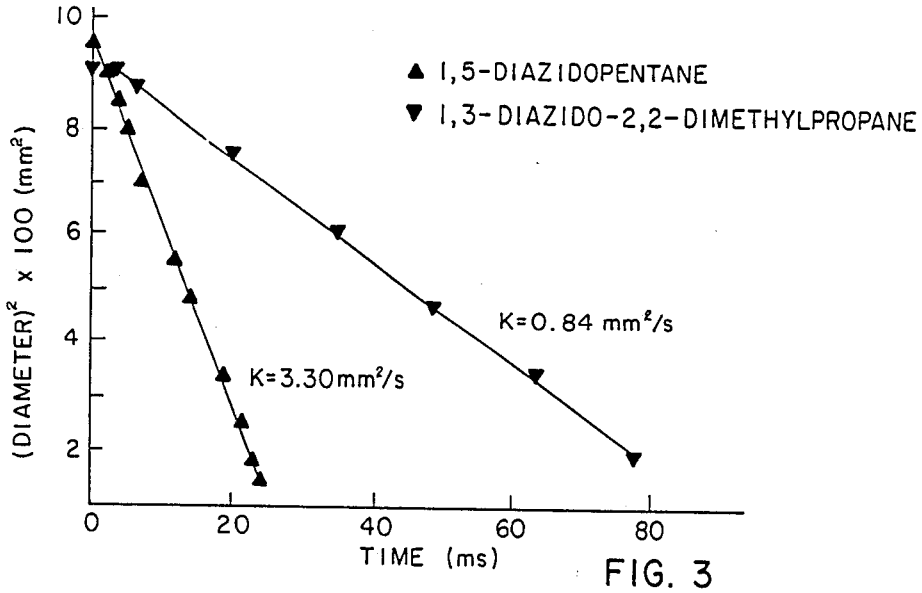
FIG. 3 presents a plot of the square of instantaneous droplet diameter versus time for straight and branched chained diazide isomers in air.

Additional experiments have been performed on the dependence of the burning rate on the structure of the base molecule. FIG. 3 compares the $D^2$ versus time behavior for the straight-chain 1,5-diazidopentane and the branched-chain 1,3-diazido-2,2-dimethylpropane. In these two molecules the molecular weights as well as the numbers of C, H, and N atoms are all matched. The only difference is the arrangement of the chain structure. It is seen that the branched-chain diazido molecule burns with a rate comparable with that of n-alkanes, and therefore substantially slower than those of the straight-chain diazido compounds.

Figure 4:
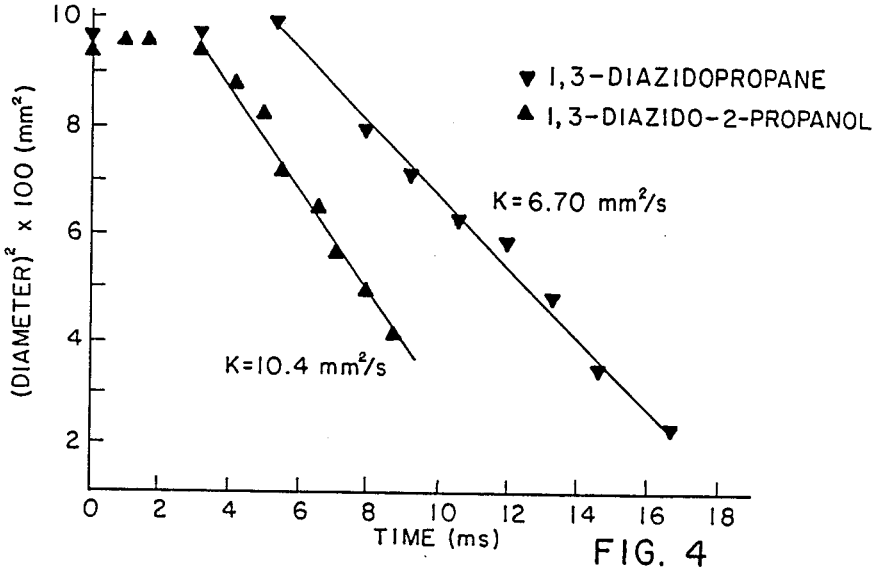
FIG. 4 presents a plot of the square of the instantaneous droplet diameter versus time for 1,3-diazidopropane and 1,3-diazido-2-propanol in air.

FIG. 4 compares the burning rates of 1,3-diazidopropane and 1,3-diazido-2-propanol. The results show that the presence of the OH group enhances the burning rate, yielding the highest burning rate constant, $K=10.4$ $mm^2/s$, determined in the present investigation.

Figure 5:
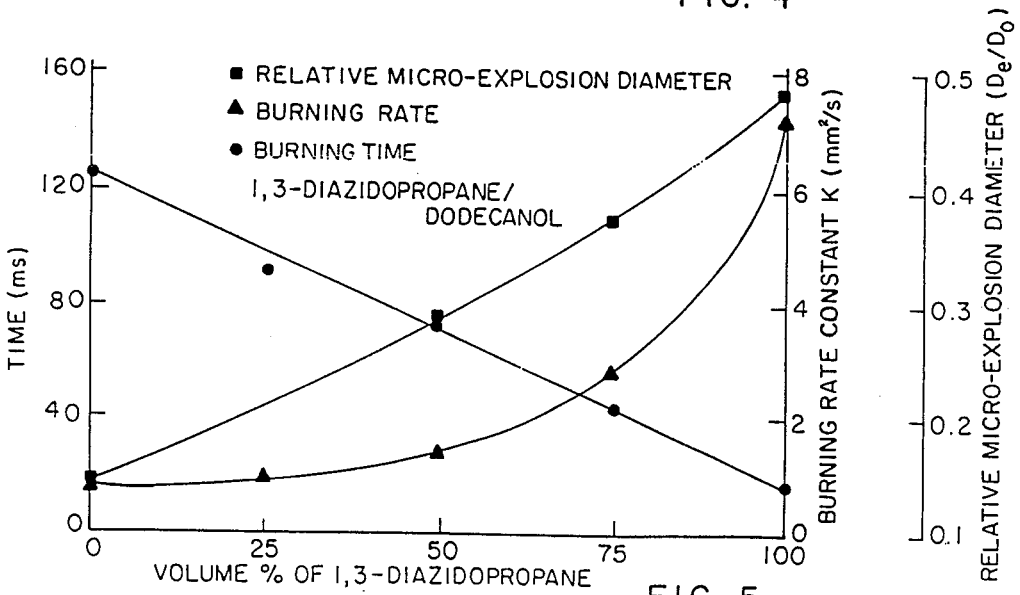
FIG. 5 presents a graph showing the burning rate constant (K) and relative micro-explosion diameters ($D_e/D_o$) for mixtures 1,3-diazidopropane and dodecanol in air.

Experiments have also been conducted for mixtures of organic azides and other hydrocarbon fuels. FIG. 5 shows K and $D_e/D_o$ for mixtures of 1,3-diazidopropane and dodecanol. It is seen that both K and $D_e/D_o$ increase monotonically with increasing azide content. Compared with the result of FIG. 4 it can also be stated that the positive influence of the OH group is effective only when it is present in the azide molecule. It has no effect when attached to another molecule even when they are in the same mixture. This then implies that the influence of OH is through modification of the decomposition of the azides.

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A liquid hydrocarbon ramjet fuel comprising from more than zero to 100 weight percent of a diazido alkanol of the general formula $N_3CH_2(CH_2)_xCHOH(CH_2)_yCH_2N_3$ wherein x is an integer of from 0 to 9, y is an integer of from 0 to 19, $x+y$ is an integer of from 0 to 19, and $x \leqq y$, and the balance being a conventional jet fuel.

2. The liquid hydrocarbon ramjet fuel of claim 1 which comprises from more than zero to less than 50 weight percent of the diazido alkanol.

3. The liquid hydrocarbon ramjet fuel of claim 2 which comprises from 0.5 to 20 weight percent of the diazido alkanol.

4. The liquid hydrocarbon ramjet fuel of claim 3 which comprises from 0.5 to 10 weight percent of the diazido alkanol of claim 3.

5. The liquid hydrocarbon ramjet fuel of claim 1 wherein x is an integer of from 0 to 3, y is an integer of from 0 to 7, $x+y$ is an integer of from 0 to 7, and $x \leqq y$.

6. A method of producing propulsion comprising combusting the liquid hydrocarbon fuel of claim 1 in a ramjet.

7. A method of producing propulsion comprising combusting the liquid hydrocarbon fuel of claim 2 in a ramjet.

8. A method of producing propulsion comprising combusting the liquid hydrocarbon fuel of claim 3 in a ramjet.

9. A method of producing propulsion comprising combusting the liquid hydrocarbon fuel of claim 4 in a ramjet.

* * * * *